United States Patent [19]

Golby

[11] Patent Number: 4,573,750

[45] Date of Patent: Mar. 4, 1986

[54] DISPENSING APPARATUS

[75] Inventor: John B. Golby, Swannington Leics, Great Britain

[73] Assignee: Glynwed Screws & Fastenings Limited, Birmingham, England

[21] Appl. No.: 568,601

[22] Filed: Jan. 6, 1984

[30] Foreign Application Priority Data

Jan. 8, 1983 [GB] United Kingdom ..... 8300477

[51] Int. Cl.[4] ..... B65H 19/00

[52] U.S. Cl. ..... 312/38; 312/39

[58] Field of Search ..... 312/37, 38, 39, 40, 312/41

[56] References Cited

U.S. PATENT DOCUMENTS

| | | | |
|---|---|---|---|
| 1,298,909 | 4/1919 | DeBersaques | 312/38 |
| 2,899,251 | 8/1959 | Birr | 312/38 |
| 3,214,226 | 10/1965 | Bahnsen | 312/38 |
| 3,222,112 | 12/1965 | Bahnsen | 312/38 |
| 3,323,848 | 6/1967 | Bahnsen | 312/38 |
| 3,563,623 | 2/1971 | Walton | 312/38 |
| 3,826,548 | 7/1974 | Schnyder et al. | 312/38 |
| 3,858,951 | 1/1975 | Rasmussen | 312/38 |
| 3,858,953 | 1/1975 | Bahnsen | 312/38 |
| 4,270,818 | 6/1981 | McCabe | 312/38 |

FOREIGN PATENT DOCUMENTS

| | | | |
|---|---|---|---|
| 2096099 | 10/1982 | United Kingdom | 312/38 |

*Primary Examiner*—William E. Lyddane
*Assistant Examiner*—Thomas A. Rendos
*Attorney, Agent, or Firm*—McCormick, Paulding & Huber

[57] ABSTRACT

A towel dispensing apparatus comprises an electrically-operated towel winding mechanism for winding-up the tail end of a used towel. The towel winding mechanism comprises a battery operated electric motor coupled to a towel winding roller. A limiting mechanism which limits the length of towel dispensed during use of the apparatus is disabled during tail end wind-up by a solenoid-operated disabling member. The motor and solenoid are energized when pressure switches detect passage out of the cabinet of the towel end. The disabling mechanism can operate only after withdrawal of the towel end from the cabinet.

4 Claims, 4 Drawing Figures

DISPENSING APPARATUS

This invention relates to towel dispensing apparatus such as, for example, towel dispensing apparatus of the kind used in towel-dispensing cabinets employing a roll of towelling which is dispensed from the cabinet in successive portions in response to a pulling action by the user, and the used towelling is likewise continuously taken up into the cabinet.

A problem which arises in the case of such towel dispensing apparatus is that when the roll of clean towelling is exhausted and the end of the towelling roll has been pulled from the cabinet, this end is no longer supported by the cabinet and falls to the ground and not only becomes unduly soiled but is inconvenient and somewhat unsightly.

Prior proposals of which the Applicants are aware have not provided an adequate response to the above problem. For example, it has been proposed to provide a mechanism intended to wind-up the end of the towelling roll into the cabinet. However, the mechanism proposed for this purpose is somewhat complex and expensive and necessitates a complete re-design of the towel dispensing mechanism and/or the cabinet enclosing it.

Accordingly, there is a need for towel dispensing apparatus having improved means for winding up the tail end of the towel. More particularly, it is desirable to provide apparatus whereby an existing towel dispensing mechanism can be adapted to provide wind-up of the tail end of a towel merely by the addition of components and apparatus which can fit within the existing cabinet for the apparatus. Preferably of course the additional mechanism should be relatively simple and inexpensive.

An aim of the present invention is to provide apparatus offering improvements in relation to one or more of the problems and objectives identified above.

According to one aspect of the present invention there is provided towel dispensing apparatus comprising an electrically operated towel winding mechanism. The towel winding mechanism may comprise an electric motor drivably connected to a towel winding roller. The drivable connection between the motor and the roller preferably provides for torque increase between the motor and the roller. Preferably also the towel winding mechanism is arranged to be battery operated.

According to another aspect of the present invention there is provided towel dispensing apparatus comprising a limiting mechanism to limit the rotation of a towel winding roller of the dispensing apparatus whereby the length of towel dispensed by the apparatus is limited, wherein electrically operated disabling means is provided to prevent operation of the limiting mechanism when the disabling mechanism is actuated so that the towel winding roller can rotate without limitation by said limiting mechanism. Preferably the disabling mechanism comprises a solenoid. A disabling element may be arranged to be actuated by the solenoid, the disabling element being adapted to prevent the establishment or to destroy a vacuum between suction cups of the limiting mechanism.

According to another aspect of the present invention there is provided towel dispensing apparatus comprising electrically operated means to detect the end of a towel dispensed. Said electrically operated means to detect may comprise a transducer or switch element responsive to thrust or pressure exerted thereon by a towel dispensed, or to the absence of such thrust or pressure, to provide a signal. Towel guide means may be provided to cause the towel to pass around the transducer or switch element so that the towel exerts said thrust or pressure thereon.

According to a further aspect of the invention there is provided towel dispensing apparatus comprising an electrically operated towel end wind up mechanism. Preferably said end wind up mechanism comprises electrical control means. The control means may be operative to provide for a time delay after detection of a towel end and before the towel winding mechanism is energised. The control means may also provide for a disabling mechanism to be actuated so as to disable a limiting mechanism which would otherwise inhibit winding of the towel. Preferably also the control means is arranged to energize the wind up mechanism for a predetermined time interval so as to ensure full wind-up of the towel end.

The invention also provides a kit of parts whereby an existing towel dispensing mechanism may be adapted for towel tail end wind-up and/or for disabling of the limiting mechanism thereof.

The invention also provides any concept or feature or combination of features defined and/or described and/or illustrated in this specification and drawings.

An embodiment of the invention will now be described by way of example with reference to the accompanying drawings in which.

Figure 1:
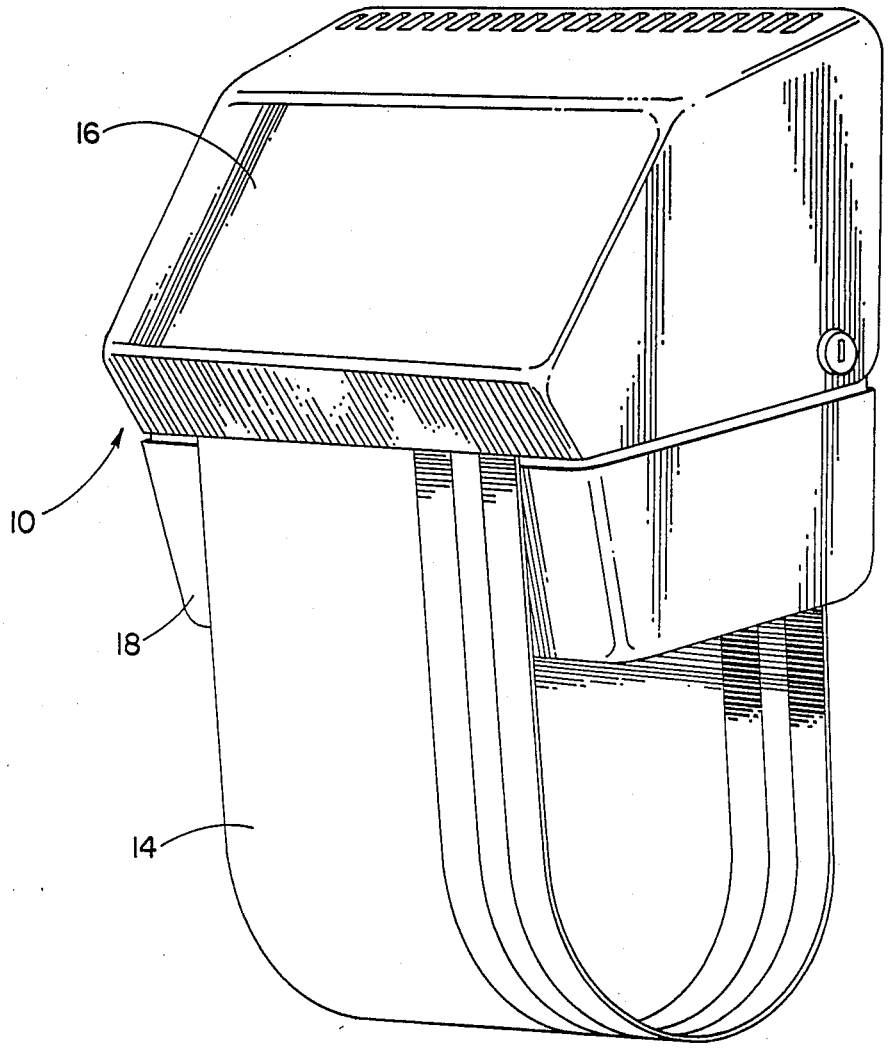
FIG. 1 shows a perspective view of a towel cabinet containing towel dispensing apparatus and showing a loop of towelling ready for use.
Figure 2:
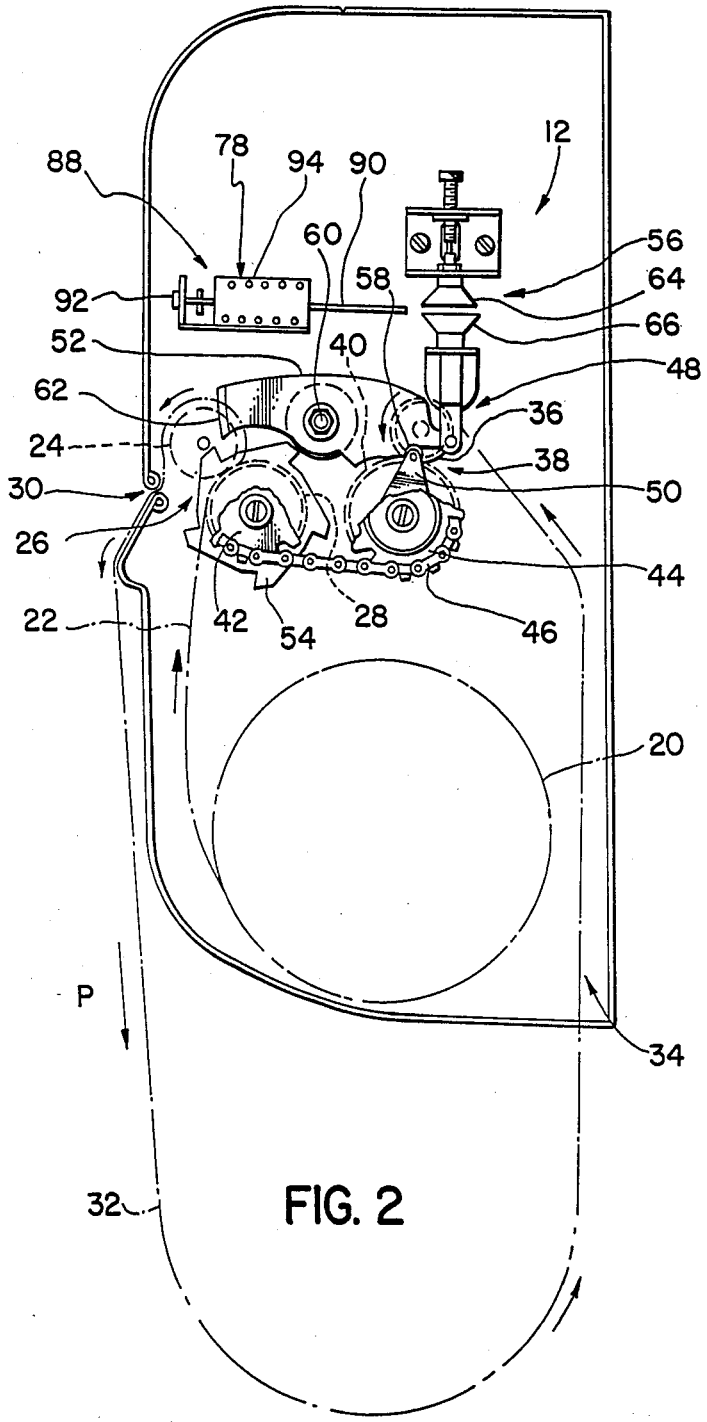
FIG. 2 shows a sectioned side elevation view of a towel cabinet showing the path of a towel therethrough and some details of a limiting mechanism and of a disabling mechanism therefor. The profile of the cabinet shown in FIG. 2 differs from that of FIG. 1 but this is merely to show the application of the apparatus described herein to a variety of cabinet profiles.
Figure 3:
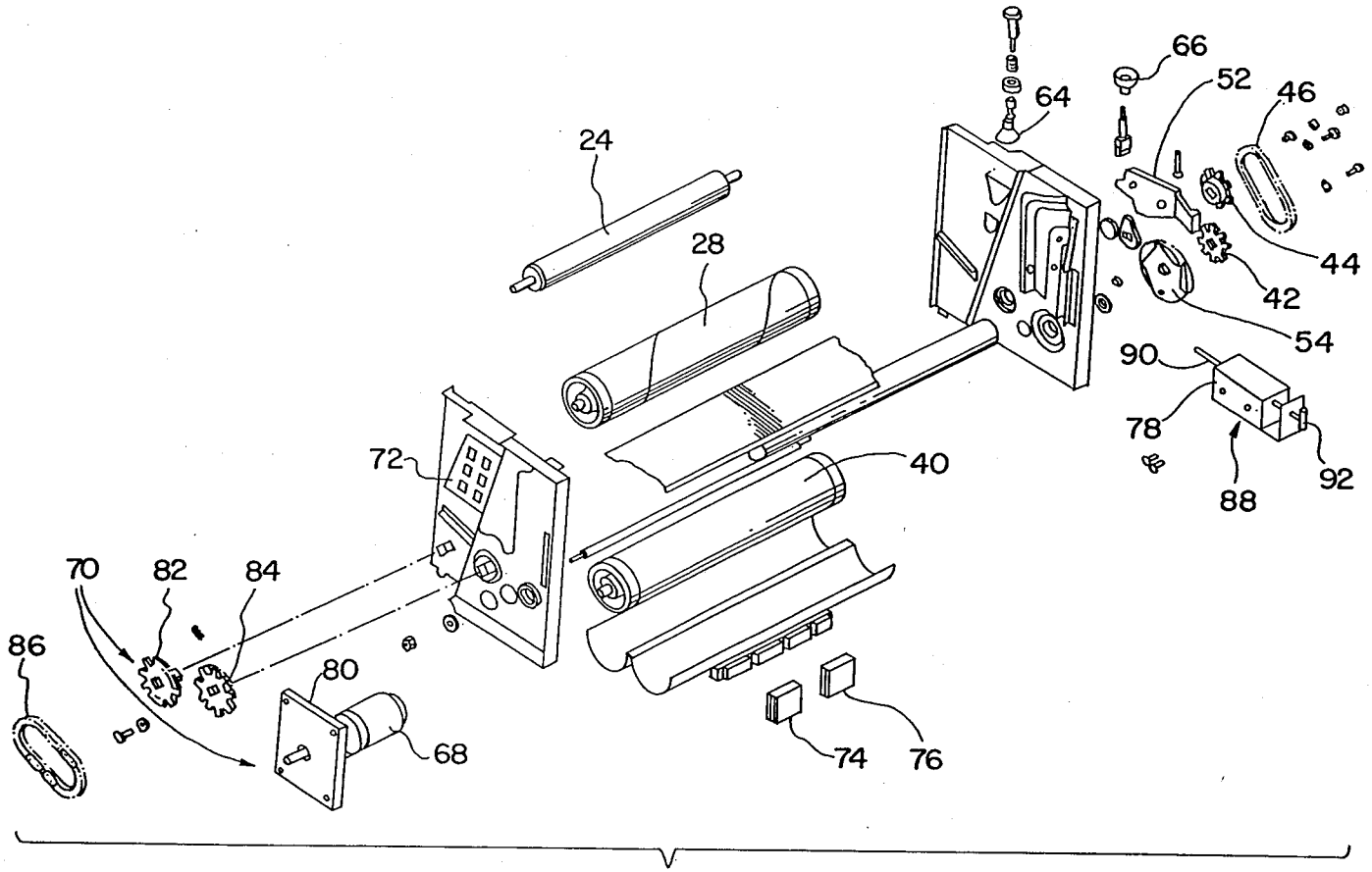
Figure 4:
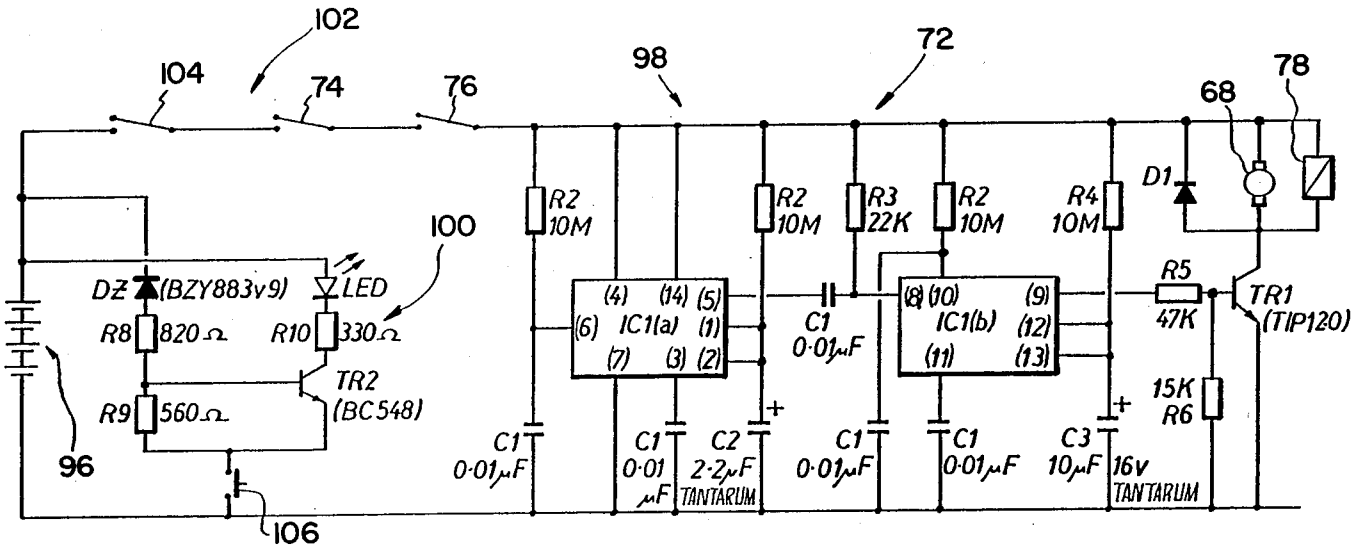

FIG. 3 shows an exploded view of the towel dispensing apparatus of the cabinets of FIGS. 1 and 2, including the limiting mechanism, a disabling mechanism operative thereon, and an electrically operated towel wind-up mechanism for retracting a towel end into the cabinet; and FIG. 4 shows a circuit diagram for the electrically operated towel wind-up mechanism of the apparatus of the preceding figures.

As shown in the drawings, a towel dispensing cabinet 10 contains towel dispensing apparatus 12 for dispensing a long roll of towel 14.

Cabinet 10 comprises hinged upper and lower cabinet portions 16, 18 respectively which are openable to permit new and used rolls of towelling to be inserted into and removed from the cabinet.

As shown in FIG. 2 the path of a towel during use is as follows. The roll of clean towel 20 is contained in the cabinet lower portion or bottom bucket 18 and the towel extends from the roll in an upwards run 22 to a floating roller 24. The towel passes into the nip 26 between floating roller 24 and first main towel roller 28 and then passes counterclockwise round floating roller 24 and downwards through the dispensing slot 30 in the cabinet and thence to the towel loop portion 32 where a user dries his or her hands on the towel. From loop 32 the towel passes upwards through a rear opening 34 back into the cabinet and passes counterclockwise round a second floating roller 36 and into the nip 38 between floating roller 36 and a second main towel roller 40. The towel is mounted on floating roller 36 so as to wind-up thereon, and this roller thus provides towel take-up and the entire length of towelling is eventually wound onto roller 36 after use, the roller floating upwards to accommodate the increasing diameter of the roll of towelling thereon.

End sprockets 42 and 44 are provided at the ends of the main towel rollers 28 and 40 respectively, the sprockets being connected by a chain 46. As a result, a downward pull in the direction P by a user on the loop portion 32 of the towel causes floating roller 24 to press against roller 28 so that the towel is firmly gripped between rollers 24, 28 and drive is transmitted to roller 28 and thence via chain 46 to the second main towel roller 40. The latter roller frictionally engages the second floating roller 36 causing the latter to rotate and to take-up the used towelling at the same rate that it is dispensed, whereby towel loop 32 remains at a constant length throughout the period of use.

A limiting mechanism 48 is provided to limit the length of towel which can be obtained by a user at a single pull on towel loop portion 32.

Limiting mechanism 48 comprises a roller cam arm 50 rotatable with sprocket 44 on the second main towel roller 40, a pivoted stop lever 52, a ratchet wheel 54 and a delay mechanism 56. Cam arm 50 engages a cam surface 58 on stop lever 52 so as to pivot the latter counterclockwise about pivot axis 60, thereby bringing stop 62 at the end of lever 52 into engagement with one of the teeth of ratchet wheel 54 and also bringing suction cups 64, 66 of delay mechanism 56 into vacuum engagement. In this condition, the towel rollers are prevented from rotating and the user can obtain no more clean towelling. After a short delay, the vacuum between suction cups 64, 66 collapses, the suction cups part and stop lever 52 returns to the position shown in FIG. 2 and further towel can be obtained by the next user.

An electrically operated towel winding mechanism is provided to enable the end of a roll of clean towelling (the inner end of roll 20 in FIG. 2) to be wound up into cabinet 10 after it has been used. The towel winding mechanism comprises an electric motor 68, a drive transmission 70, an electrical control circuit 72, a pair of pressure switches 74, 76 and a solenoid 78.

Motor 68 is powered by a series of dry cell batteries (not shown) mounted within cabinet 10 in end-to-end series arrangement to provide a 6 volt direct current supply. Obviously, many different kinds of alternative electrical supply could be provided, including even mains operation if desired.

Drive transmission 70 comprises a transmission housing 80, a pair of sprockets 82, 84 and an associated drive chain 86 whereby drive can be transmitted from motor 68 to the second main towel roller 40. Drive transmission 70 may be adapted to step-up or step-down the torque transmitted according to the operational characteristics of motor 68. In the case of a small direct current motor, a torque increase is usually required.

Pressure switches 74, 76 are provided to detect the passage of the end of the clean towel through dispensing slot 30. The switches are not shown in FIG. 2 but are mounted within the cabinet immediately behind slot 30 so that the towel passes over the switches as it proceeds from roller 24 to the slot. A pressure plate with apertures positioned to correspond with the pressure switches is mounted on the cabinet so that, in the closed condition of the latter, the pressure plate presses the towel against the pressure switches and thereby actuates the latter. In the absence of the towel, when the end thereof has been dispensed, the pressure switches are no longer actuated by the towel and signal that the towel end has been dispensed. Switches 74 and 76 are electrically connected to control circuit 72 which is likewise electrically connected both to motor 68 and solenoid 78.

Solenoid 78 forms part of a disabling mechanism 88 for the limiting mechanism 48. A disabling element 90 is mounted for actuation by the solenoid so as to pass between suction cups 64, 66 thereby to prevent or destroy a vacuum between the cups and hence to disable the limiting mechanism. As shown in FIG. 2, solenoid 78 has an adjuster 92 to adjust the extended position of disabling element 90 and is also provided with a return spring 94 whereby element 90 is retracted after use.

FIG. 4 shows the circuit diagram for control circuit 72 whereby electrical power from a battery 96 energises motor 68 and solenoid 78 in a controlled manner. Basically, control circuit 72 comprises a time control circuit 98, a battery test circuit 100 and a control switch assembly 102, the latter including a safety microswitch 104.

The broad functions of these parts of the control circuit 72 are as follows. Safety microswitch 104 interrupts the power supply to motor 68 and solenoid 78 at all times except when it is proper for these mechanisms to be energised. Pressure switches 74 and 76 detect the passage of a towel end from the cabinet for the purpose of energising the towel winding mechanism. Time control circuit 98 provides for a time delay after detecting passage of the towel end and before energising motor 68 and solenoid 78. After such time delay the motor and solenoid are energised for a time interval determined by the control circuit 98. Battery test circuit 100 enables the state of battery 96 to be rapidly tested at the time of towel replacement to determine whether the battery should also be replaced.

Time control circuit 98 is built around integrated circuit IC1(*a*) and (*b*) which is a type 7556 timer circuit, connected and biased as shown.

Battery test circuit 100 comprises a resistance network, a zener diode DZ, a transistor TR2 and a light emitting diode LED connected across battery 96 by means of a test switch 106. Finger pressure on switch 106 will result in emission of light from diode LED if the battery 96 is fit for continued use. Otherwise, the battery should be replaced.

Safety microswitch 104 is mounted on cabinet 10 so that immediately upon opening the cabinet portions 16, 18 the microswitch is moved to the open-circuit position shown in FIG. 4 thus de-energising the entire electrical system. The microswitch may be mounted in any convenient position within the cabinet for actuation by relative movement of any convenient parts of the upper and lower cabinet portions.

In use, the apparatus operates as follows. On initial setting-up of the apparatus the cabinet portions 16 and 18 are closed thereby closing microswitch 104. Installation of a clean towel in the mechanism causes pressure switches 74, 76 to be moved to their open-circuit position as shown in FIG. 4. Throughout the period of use of the clean towel and before the end of the roll of towel 20 is reached, the pressure switches 74, 76 are in their open-circuit position so that control circuit 72, motor 68 and solenoid 78 are not energised. When the end of the towel passes the pressure switches 74, 76 and no longer exerts any thrust or pressure thereon, the switches close thereby energising the control circuit causing the latter to commence the towel wind-up procedure.

Initially, the control circuit provides a delay of 20 seconds while the user who has withdrawn the towel end from the cabinet completes drying of his or her hands. After the 20 second period has elapsed control circuit 72 energises both motor 68 and solenoid 78. Disabling element 90 is thereby thrust between suction cups 64, 66 thereby preventing the generation of a vacuum between the cups and disabling the limiting mechanism, whereby stop lever 52 is no longer held in position to engage the ratchet teeth of ratchet wheel 54, and rollers 28 and 40 are able to freely rotate under drive transmitted thereto by motor 68. The rollers are rotated in the same direction as during normal dispensing of the towel whereby the towel end is drawn up into the cabinet and rolled onto the roll of used towelling on second floating roller 36. Control circuit 72 is constructed to cause motor 68 and solenoid 78 to be energised for a period (for example 105 seconds) sufficient to ensure the towel end is fully wound up, after which the control circuit de-energises the motor and the solenoid, the disabling element 90 is withdrawn by spring 94 from between suction cups 64, 66 and the wind-up operation is complete and current consumption from battery 96 ceases.

When the towel cabinet is serviced, upon insertion of a new clean towel into the cabinet and over the pressure switches, these switches move to their open-circuit positions thereby de-energising the control circuit and the latter returns to the condition in which it is ready once again to energise the wind-up mechanism when the towel end is reached. The service operator checks the state of the battery 96 at the same time as the towel is replaced by merely depressing test switch 106.

It is noteworthy that the arrangement of safety microswitch 104 and control circuit 72 in association with pressure switches 74, 76 is such that motor 68 and solenoid 78 can only be energised when the towel cabinet is closed and the end of the clean towel has come out of the cabinet. It is not possible to energise the motor or the solenoid when the towel cabinet has been opened nor when any portion of the clean towel remains unwithdrawn from the towel cabinet.

Among the principal advantages of the wind up mechanism described above are its relatively simple and inexpensive construction, the fact that it is readily mounted in the limited space within an existing towel cabinet and its effectiveness in operation.

Many modifications can of course be made in the embodiment described above while remaining in the scope of the invention. Obviously, modification of the details of the electric motor and the drive from it to the towel rollers may be required for various types of installation. The drive may be connected to either or both of the towel rollers 28, 40. The pressure switches 74, 76 may be replaced by any suitable transducer or detector device such as a photo-electric device, the latter being of course associated with an appropriate switch. The disabling mechanism may take various forms appropriate to the particular form of time-delay mechanism incorporated in the cabinet. The disabling mechanism need not be solenoid-operated. Obviously, many modifications can be made by those skilled in the art in the control circuit, the timer circuit and the battery test circuit.

I claim:

1. Manually powered towelling dispensing apparatus of the kind in which a user by manually pulling on towelling removes clean towelling from a supply, the apparatus having:

a. a housing to accommodate a roll of clean towelling to be dispensed and to accommodate said dispensed towelling in a roll after it becomes soiled by use;

b. towelling control means including a dispensed towelling take-up, said towelling control means being drivably coupled to said clean towelling to be dispensed and drivably interconnecting said clean towelling being dispensed with said dispensed towelling being rewound for driving said dispensed towelling take-up in response to withdrawal of said clean towelling from the supply;

c. said towelling control means further including means for limiting the length of clean towelling dispensed in each manual dispensing operation, said limiting means having a pair of mutually engagable suction cups for holding said limiting means in a limiting condition when said suction cups are in vacuum engagement to inhibit the dispensing of clean towelling;

characterized by d. towelling end wind-up means operable in the absence of manual intervention for winding into said housing an end of a roll of clean towelling after the remainder of said roll of clean towelling has been dispensed manually, said wind-up means comprising:

(1) electrically responsive towelling end detection means for generating an electrical signal upon detection of an end of a length of clean towelling;

(2) an electrical control circuit for controlling said towelling end wind-up means;

(3) electrically operated disabling means, including a disabling element, said disabling means being electrically connected to said electrical control circuit and responsive to said signal from said towelling end detection means for displacing said disabling element to a disabling position between said suction cups upon detection of said towelling end to maintain said limiting mechanism in a non-limiting condition in which vacuum engagement of said suction cups is prevented and dispensing of clean towelling is not inhibited; and (4) an electrically actuated motor for towelling winding and electrically connected to said electrical control circuit and mechanically connected to the towelling control means to drive said towelling control means in a direction for dispensed towelling take-up while said limiting means is maintained in its nonlimiting condition to permit continuous winding of said towelling end.

2. The apparatus of claim 1 characterized in that said electrical control circuit comprises time delay means for providing a time delay after detection of a towel end and before the towel winding motor is energized.

3. The apparatus of claim 2 characterized by said electrical control circuit comprising timing means for energizing the motor for a predetermined time interval to ensure wind-up of a towel end.

4. The apparatus of claim 1 characterized in that said end wind-up means includes a towel winding roller and said electrically actuated motor is a battery operated electric motor drivably connected to a towel winding roller, the drivable connection between the motor and the roller providing for torque increase between the motor and the roller.

* * * * *